US007954552B2

(12) United States Patent
Mandrou et al.

(10) Patent No.: US 7,954,552 B2
(45) Date of Patent: Jun. 7, 2011

(54) OVERRIDING A PRIMARY CONTROL SUBSYSTEM OF A DOWNHOLE TOOL

(75) Inventors: Laure Mandrou, Pearland, TX (US); Emmanuel Rioufol, Houston, TX (US); Ahmed Saleh, Houston, TX (US); Jerome Prost, Meudon (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 82 days.

(21) Appl. No.: 12/120,335

(22) Filed: May 14, 2008

(65) Prior Publication Data

US 2009/0283276 A1 Nov. 19, 2009

(51) Int. Cl.
*E21B 34/10* (2006.01)

(52) U.S. Cl. ..... 166/375

(58) Field of Classification Search ..... 166/374, 166/375, 320, 321, 323, 319, 383, 332.1, 166/332.3; 251/26, 31; 91/33
See application file for complete search history.

(56) References Cited

U.S. PATENT DOCUMENTS

| | | | | |
|---|---|---|---|---|
| 3,786,865 | A | 1/1974 | Tausch | |
| 3,786,866 | A | 1/1974 | Tausch | |
| 4,356,867 | A | 11/1982 | Carmody | |
| 4,411,316 | A | 10/1983 | Carmody | |
| 4,624,315 | A | 11/1986 | Dickson | |
| 4,660,646 | A | 4/1987 | Blizzard | |
| 4,676,307 | A | 6/1987 | Pringle | |
| 4,723,606 | A | 2/1988 | Vinzant | |
| 4,796,705 | A | 1/1989 | Carmody | |
| 4,838,355 | A | 6/1989 | Leismer | |
| 4,951,753 | A | 8/1990 | Eriksen | |
| 5,127,476 | A | 7/1992 | Dickson | |
| 5,167,284 | A | 12/1992 | Leismer | |
| 5,310,004 | A | 5/1994 | Leismer | |
| 5,343,955 | A | 9/1994 | Williams | |
| 6,491,106 | B1 | 12/2002 | Simonds | |
| 6,502,640 | B2 | 1/2003 | Rayssiguier | |
| 6,505,684 | B2 | 1/2003 | Rayssiguier | |
| 6,513,594 | B1 | 2/2003 | McCalvin | |
| 6,523,613 | B2 | 2/2003 | Rayssiguier | |
| 6,575,249 | B2 | 6/2003 | Deaton | |
| 6,705,593 | B2 | 3/2004 | Deaton | |
| 7,347,270 | B2 | 3/2008 | McMillan | |
| 2003/0234104 | A1 | 12/2003 | Johnston | |
| 2007/0027245 | A1 | 2/2007 | Vaidya | |
| 2007/0142547 | A1 | 6/2007 | Vaidya | |
| 2009/0014168 | A1* | 1/2009 | Tips et al. | 166/73 |
| 2009/0050333 | A1* | 2/2009 | Smith et al. | 166/375 |

FOREIGN PATENT DOCUMENTS

| | | |
|---|---|---|
| EP | 1241322 | 1/2006 |

(Continued)

*Primary Examiner* — Shane Bomar
*Assistant Examiner* — Kipp C Wallace
(74) *Attorney, Agent, or Firm* — Brandon S. Clark; Rodney V. Warfford; Tim Curington

(57) ABSTRACT

A system that is usable with a well may include a piston, a primary control subsystem and an override subsystem. The piston actuates the downhole tool, and the primary control subsystem may be connected to at least one hydraulic line in order to move the piston in response to pressure that is communicated to the tool via the hydraulic line(s). The override subsystem may be connected to the hydraulic line(s) to override the primary control subsystem and move the piston in response to pressure communicated to the tool via the hydraulic line(s).

6 Claims, 7 Drawing Sheets

FOREIGN PATENT DOCUMENTS

| | | | |
|---|---|---|---|
| GB | 2374369 | A | 10/2002 |
| GB | 2376055 | | 12/2002 |
| GB | 2388854 | A | 11/2003 |
| GB | 2389405 | | 12/2003 |
| GB | 2389406 | | 12/2003 |
| GB | 2396200 | | 6/2004 |
| GB | 2433262 | | 6/2007 |
| WO | 2006134508 | | 12/2006 |

* cited by examiner

OVERRIDING A PRIMARY CONTROL SUBSYSTEM OF A DOWNHOLE TOOL

BACKGROUND

The invention generally relates to overriding a primary control subsystem of a downhole tool.

Downhole tools typically are used in a well to perform functions related to the drilling, testing and completion of the well, in addition to functions related to monitoring and controlling downhole production or injection after the well's completion. Such tools include flow control valves, isolation valves, circulation valves, perforating guns, sleeve valves, ball valves, etc. A typical downhole tool contains a primary control subsystem that responds to control stimuli, such hydraulic pressure, fluid pulses, electrical signals, etc. for purposes of operating the tool. As an example, a primary control subsystem for a downhole tool may contain a hydraulic circuit that actuates the tool in response to hydraulic pressure that is communicated downhole via one or more hydraulic lines.

It is possible that during the lifetime of a downhole tool, the tool's primary control subsystem may fail. Conventional corrective actions, such as intervening, plugging or perforating, may be used when the primary control subsystem fails.

Intervening typically involves deploying a mechanical tool into the well on a slick line or coiled tubing to engage the downhole tool and provide an actuation force. Plugging involves placing a plug in the wellbore beneath the downhole tool and applying pressure to the plugged well, which actuates the tool. Perforating may be another option that is used, for example, when the primary control subsystem fails. For example, the tool may be a flow control valve that is part of a tubing string and controls fluid communication between the string's central passageway and the annulus of the well. More specifically, the valve may have failed in a closed position, and a perforating gun may be run downhole and used to perforate the tubing string for purposes of re-establishing a flow path between the annulus and the central passageway.

SUMMARY

In an embodiment of the invention, a system that is usable with a well includes a piston, a primary control subsystem and an override subsystem. The piston actuates a downhole tool, and the primary control subsystem is connected to at least one hydraulic line to move the piston in response to pressure communicated to the tool via the hydraulic line(s). The override subsystem is connected to the hydraulic line(s) to override the primary control subsystem and move the piston in response to pressure that is communicated to the tool via the hydraulic line(s).

In another embodiment of the invention, a technique that is usable with a well includes providing a downhole tool that includes a primary control system, which is operated by applying pressure to fluid in a supply line that extends to the downhole tool and receiving fluid from the downhole tool through a return line. The technique includes overriding the primary control system, including applying pressure to fluid in the return line and receiving fluid from the supply line.

In another embodiment of the invention, a technique that is usable with a well includes providing a downhole tool that includes a primary control system, which is operated by applying pressure below a threshold to fluid in a supply line extending to the downhole tool and receiving fluid from the downhole tool through a return line. The technique includes overriding the primary control system, including applying pressure to fluid in the supply line above the threshold and receiving fluid from the return line.

In yet another embodiment of the invention, a technique that is usable with a well includes providing a downhole tool that includes a primary control system, which is operated by applying pressure to fluid in a supply line that extends to the downhole tool and receiving fluid from the downhole tool through at least one of a plurality of return lines. The technique includes overriding the primary control system, including selectively pressurizing the return lines.

Advantages and other features of the invention will become apparent from the following drawing, description and claims.

DETAILED DESCRIPTION

In the following description, numerous details are set forth to provide an understanding of various embodiments of the present invention. However, it will be understood by those skilled in the art that these embodiments of the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
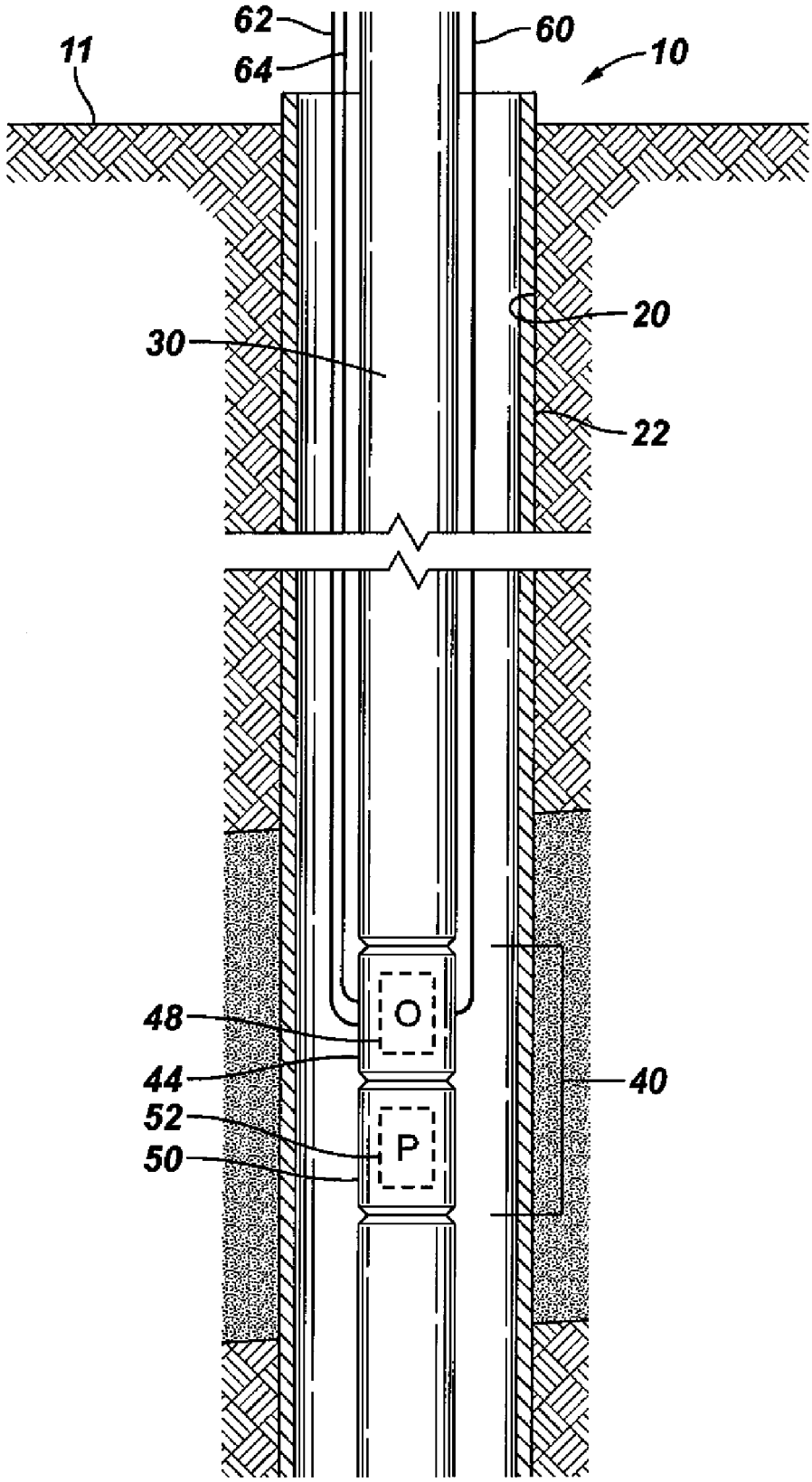
FIG. 1 is a schematic diagram of a well according to an embodiment of the invention.

Referring to FIG. 1, in accordance with an illustrative embodiment of the invention, a well (a subsea well or subterranean well, as examples) includes a wellbore 20 that extends downhole from the Earth surface 11 of the well 10. The well 10 may or may not be cased by a casing string 22, and the wellbore 20 may be a main wellbore (as shown) or may be a branch wellbore. Furthermore, the wellbore 20 may be a lateral or deviated wellbore, in accordance with other embodiments of the invention. A tubing string 30 extends downhole into the wellbore 20 and contains a downhole tool 40. As a non-limiting example, the downhole tool 40 may be a valve, such as a sleeve valve, although various types of valves and downhole tools are contemplated and are within the scope of the appended claims.

In accordance with embodiments of the invention, the tool 40 may be operated via hydraulic pressure that is communicated to the tool 40 through the use of hydraulic lines 62 and 64 that extend from the surface 11 of the well to the tool 40. More specifically, in accordance with some embodiments of the invention, the hydraulic line 62 may be a supply line that receives hydraulic fluid at the surface 11 of the well from a surface-located hydraulic source (not shown) for purposes of delivering pressurized fluid to the tool 40 in order to actuate the tool 40. The hydraulic line 64 may be a dump line, or return line, which receives hydraulic fluid that is displaced due to the actuation of the tool.

In general, the hydraulic lines 62 and 64, in conjunction with electrical lines 60 (that extend downhole from the surface 11 of the well, for example), operate a primary control subsystem 44 of the tool 40 for purposes of causing the tool 40 to perform an intended downhole function. As a more specific and non-limiting example, the primary control subsystem 44 may contain solenoid valves that are electrically operated via the electrical lines 60 for purposes of routing the hydraulic pressure supplied by the hydraulic line 62 to the appropriate control chamber of an actuator 50 of the tool 40. As a non-limiting example, the electrical lines 60 may be selectively energized by equipment (not shown) that is located at the surface 11 of the well 10.

As a non-limiting example, the downhole tool 40 may be a valve (such as a sleeve or ball-type valve, for example), and the solenoid valves may be operated to route the hydraulic fluid from the hydraulic line 62 to the appropriate chamber of the actuator 50 for purposes of causing a piston 52 of the actuator 50 to move in a particular direction so as to open the valve, as can be appreciated by one of skill in the art. Continuing the example, the solenoid valves of the primary control subsystem 44 may also be operated via the electrical lines 60 for purposes of routing the fluid pressure from the hydraulic line 62 to another control chamber of the actuator 50 to cause the piston 52 to move in the opposite direction to close the valve. For both cases, the hydraulic fluid that is displaced due to the actuation of the valve is routed to the hydraulic line 64.

It is possible that during the lifetime of the tool 40, the primary control subsystem 44 may fail. For example, one of the solenoid valves of the primary control subsystem 44 may fail open or may fail closed. For either scenario, the primary control subsystem 44 may no longer operate as intended, and the solenoid valves cannot be used to control the downhole tool 40. However, in accordance with exemplary embodiments of the invention described herein, the downhole tool 40 may include an override subsystem 48, which may be operated via the hydraulic lines 62 and 64 to override the primary control subsystem 44 for purposes of operating the tool's actuator 50.

Figure 2:
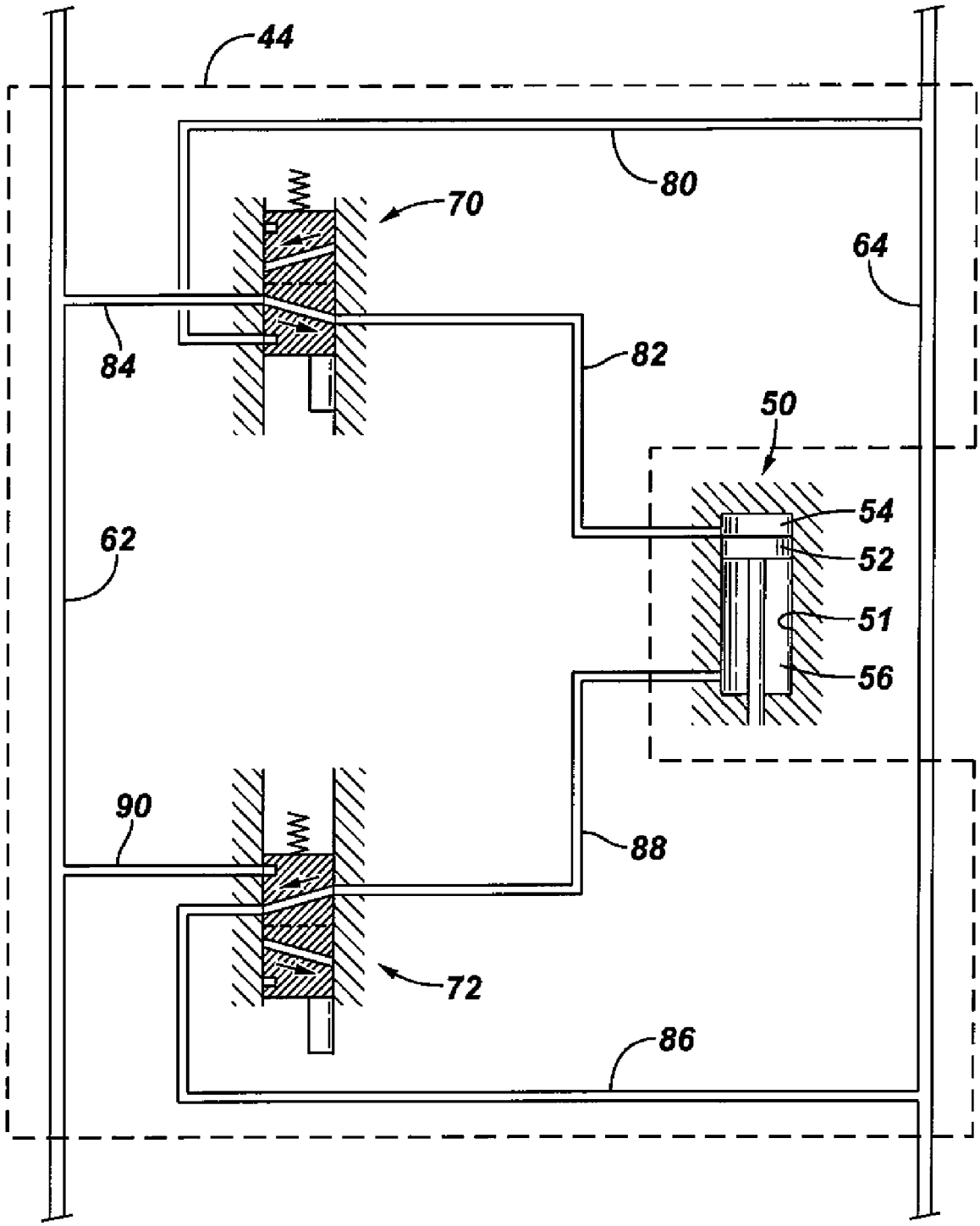
FIG. 2 is a schematic diagram of a primary control subsystem of FIG. 1 according to an embodiment of the invention.

FIG. 2 depicts one example of the primary control subsystem 44 in accordance with some embodiments of the invention. For this example, the primary control subsystem 44 may include solenoid operated valves 70 and 72 that control communication between the hydraulic lines 62 and 64 and upper 54 and lower 56 hydraulic chambers, respectively, of the actuator 50. As a non-limiting example, each solenoid valve 70, 72 may be a two position, three-way valve, as shown in FIG. 2.

In accordance with some embodiments of the invention, the actuator 50 may include a cylinder 51 that contains the piston 52. The piston 52, in turn, may include a piston head that is sealed to the interior wall of the cylinder (via o-rings on the piston head, for example) to divide the cylinder 51 into the upper 54 and lower 56 hydraulic chambers. When the upward force that is exerted on the piston head by the hydraulic fluid in the lower chamber 56 exceeds the downward force that is exerted on the piston head by the fluid in the upper hydraulic chamber 54, the piston 52 moves to its upper position (as shown in FIG. 2). As a non-limiting example, this upper position may be associated with the closed position of a valve. Conversely, when the downward force that is exerted on the piston head by the fluid in the upper hydraulic chamber 54 exceeds the upward force that is exerted on the piston head by the fluid in the lower hydraulic chamber 56, the piston 52 moves to its lower position, which may be associated with the open position of a valve, as a non-limiting example.

In general, during normal operation of the primary control subsystem 44, the solenoid valve 70 controls fluid communication with the upper hydraulic chamber 54, and the solenoid valve 72 controls fluid communication with the lower hydraulic chamber 56. In particular, each solenoid valve 70, 72 controls whether its associated chamber 54, 56 is connected to the hydraulic line 62 (i.e., the supply line for the primary control subsystem 44) or to the hydraulic line 64 (i.e., the return line for the primary control subsystem 44).

In the unactuated state of the primary control subsystem 44, the solenoid valves 70 and 72 are de-energized, or inactivated, which means that each of the valves 70 and 72 connects its associated chamber 54, 56 to the hydraulic line 64 and isolates the hydraulic line 62 from its associated chamber 54, 56.

More specifically, lines 80 and 84 connect the solenoid valve 70 to the hydraulic lines 64 and 62, respectively; and lines 90 and 86 connect the solenoid valve 72 to the hydraulic lines 62 and 64, respectively. Lines 82 and 88 form connections between the solenoid valves 70 and 72 and the upper 54 and lower 56 chambers, respectively. In the unactuated state of the primary control subsystem 44, the solenoid valve 70 connects the lines 82 and 80 together, so that the upper hydraulic chamber 54 is connected to the hydraulic line 64 (i.e., the return line). Likewise, during the unactuated state of the primary control subsystem 44, the solenoid valve 72 connects the lines 88 and 86 together so that the lower hydraulic chamber 56 is connected to the hydraulic line 64.

FIG. 2 depicts a state of the primary control subsystem 44 for driving the piston 52 from its upper position (depicted in FIG. 2) to its lower position (not shown in this figure). For this state, the solenoid valve 72 remains de-energized, or inactivated, and the solenoid valve 70 is energized, or activated. Therefore, the solenoid valve 70 connects the lines 82 and 84 and isolates the line 80 so that the hydraulic line 62 (i.e., the supply line) is connected to the upper hydraulic chamber 54. Due to its inactivated state, the solenoid valve 72 connects the lower hydraulic chamber 56 to the hydraulic line 64 (i.e., the return line). Thus, pressurized fluid in the hydraulic line 62 forces the piston 52 to its lower position, and fluid in the lower hydraulic chamber 56, which is displaced by the piston's movement is communicated to the hydraulic line 64.

It is noted that the piston 52 may be forced to its upper position by operating the solenoid valve 70 and 72 in the opposite manner. In this regard, for purposes of moving the piston 52 to its upper position, the solenoid valve 70 is de-energized, or inactivated, to connect the upper hydraulic chamber 54 to the hydraulic line 64, and the solenoid valve 72 is energized, or activated, to connect the hydraulic line 62 to the lower hydraulic chamber 56.

Figure 3:
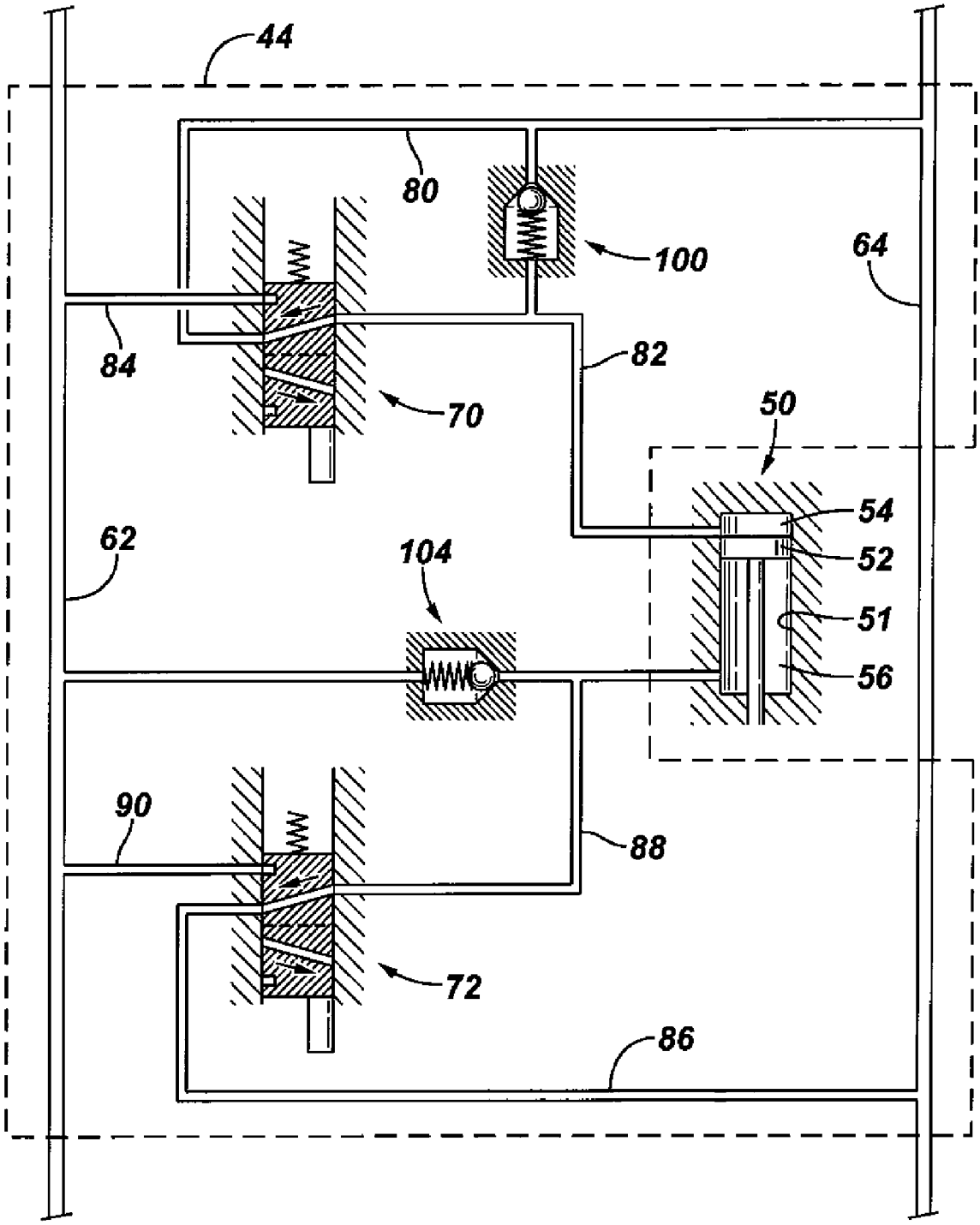
FIGS. 3, 4 and 5 are schematic diagrams of the primary control subsystem of FIG. 2 and different override subsystems according to different embodiments of the invention.

It is noted that if one or both of the solenoid valves 70 and 72 fail, the valves 70 and 72 cannot be used to control operation of the actuator 50. Therefore, referring to FIG. 3, in accordance with at least some embodiments of the invention, the override system 48 (see FIG. 1) is integrated into the primary control subsystem 44 for purposes of allowing hydraulic pressure over one or more of the hydraulic lines 62 and 64 to control the actuator 50. More specifically, FIG. 3 depicts an arrangement in which the override system 48 is formed from check valves 100 and 104, which are connected to permit hydraulic override of the primary control subsystem 44 by applying pressure to the hydraulic line 64 (i.e., the return line for normal operation of the primary control subsystem 44).

More specifically, the input of the check valve 100 is connected to the line 80 and the output of the check valve 100 is connected to the line 82 so that normal operation of the primary control subsystem 44 keeps the check valve 100 closed and prevents a flow through the valve 100 between the hydraulic line 64 and the upper hydraulic chamber 54. The input of the check valve 104 is connected to the hydraulic line 88 and the output of the check valve 104 is connected to the line 62 so that during normal operation of the primary control subsystem 44, the check valve 104 is closed, which prevents fluid communication between the hydraulic line 62 and the lower hydraulic chamber 56 through the valve 104.

Thus, during the normal operation of the primary control subsystem 44 (i.e., operation that involves the use of the solenoid valves 70 and 72), the check valves 100 and 104 remain closed and thus, do not affect operation of the primary control subsystem 44. However, upon failure of the primary control subsystem 44, the roles of the hydraulic lines 62 and 64 reverse for purposes of overriding the primary control subsystem 44: the hydraulic line 64 is used as the pressurized supply line, and the hydraulic line 62 is used as the unpressurized return line. When the hydraulic lines 62 and 64 are used in this manner, the check valves 100 and 104 open to establish communication between the now pressurized hydraulic line 64 and the upper hydraulic chamber 54 and also establish communication between the now unpressurized hydraulic line 62 and the lower hydraulic chamber 56. The application of pressure to the hydraulic line 64 causes the piston 52 to move to its lower position. Therefore, the system depicted in FIG. 3 is a one way hydraulic override system, which may be used for purposes of hydraulically overriding the primary control subsystem 44 to move the piston 52 in a particular direction (in a downward direction, for the depicted example).

As a more specific non-limiting example, in accordance with some embodiments of the invention, the downhole tool 40 may be a valve that may fail in a closed position. The one way hydraulic override system depicted in FIG. 3 may therefore be used for purposes of overriding the primary control subsystem 44 to open the valve should the primary control subsystem 44 fail.

Figure 4:
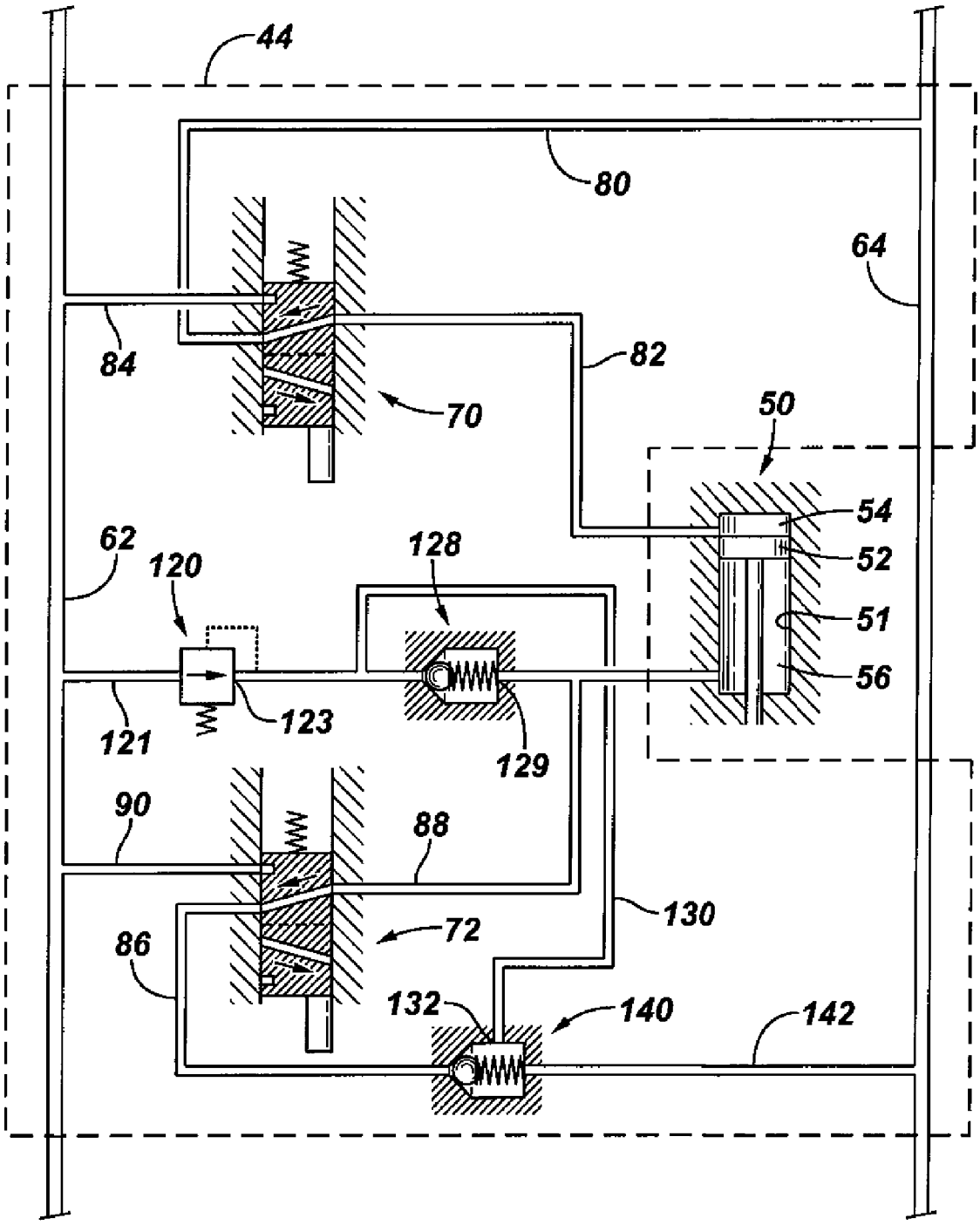

FIG. 4 depicts another one way hydraulic override subsystem that may be used with the primary control subsystem 44, in accordance with other embodiments of the invention. For this override subsystem, the hydraulic line 62 may be pressurized for purposes of overriding the primary control subsystem 44 and moving the piston 52 in a particular direction. More specifically, to activate the override feature, the hydraulic line 62 is pressurized above a threshold that exceeds the operating pressure of the hydraulic line 62 during normal operation of the primary control subsystem 44, and the hydraulic line 64 serves as the return line. A pressure regulation mechanism, such as a pressure relief valve 120, is connected to the hydraulic line 62; and establishes the threshold pressure at which the override feature is enabled. It is noted that the pressure relief valve 120 may be replaced with a rupture disk or another type of pressure bypass mechanism, in accordance with other embodiments of the invention.

For the example depicted in FIG. 4, a line 121 may connect the inlet of the pressure relief valve 120 to the hydraulic line 62, and an outlet 123 of the pressure relief valve 120 may be connected to the inlet of a check valve 128; and may also be connected to a control input 132 of the check valve 140 via a line 130. An outlet 129 of the check valve 128, in turn, may be connected to the lower hydraulic chamber 56. As depicted in FIG. 4, the inlet of the check valve 140 is connected to the line 86, and the outlet of the check valve 140 is connected to the hydraulic line 64.

During normal operation of the primary control subsystem 44, the pressure relief 120 and check 128 valves remain closed, and the check valve 140 remains open. Although the hydraulic line 62 is pressurized during normal operation of the primary control subsystem 44, the pressure remains below the pressure threshold at which the override subsystem is enabled. Therefore, to use the override feature, the pressure in the hydraulic line 62 is increased to a pressure that exceeds the threshold, which causes the pressure relief and check valves 120 and 128 to open so as to establish communication between the hydraulic line 62 and the lower hydraulic chamber 56. Upon activation of the pressure relief valve 120, the pressure that is exerted by the line 130 closes the check valve 140 to therefore isolate the lower hydraulic chamber 56 from the hydraulic line 64. Due to this hydraulic circuit, fluid pressure is communicated to the lower hydraulic chamber 56 to move the piston 52 to its upper position.

Figure 5:
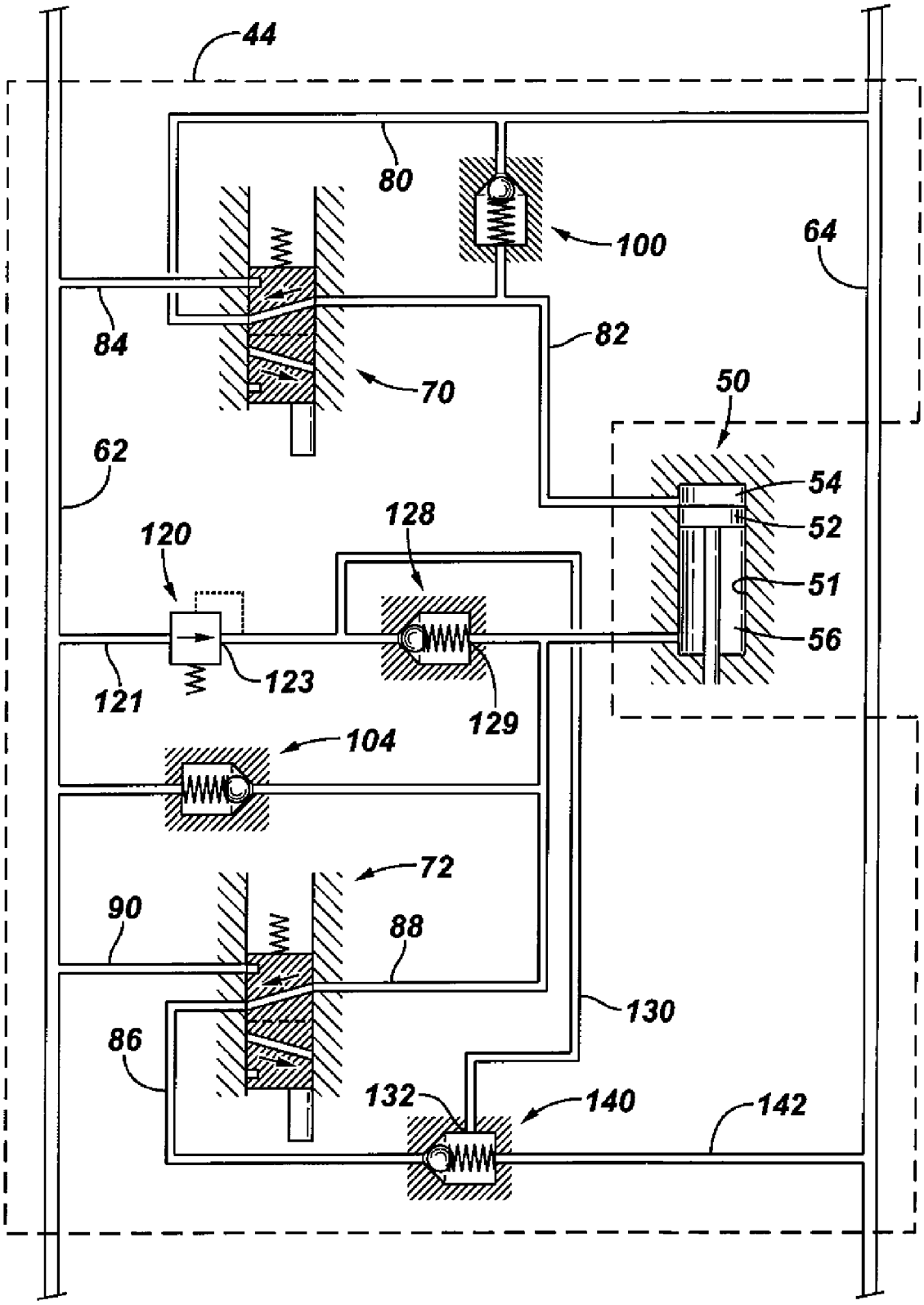

To summarize, FIG. 3 depicts an exemplary one way hydraulic override subsystem in which the hydraulic line 64 (i.e., the return line for the primary control subsystem 44) is pressurized to move the piston 52 to its lower position, and FIG. 4 depicts an exemplary one way hydraulic override subsystem in which the hydraulic line 62 (i.e., the supply line for the primary control subsystem 44) is pressurized to move the hydraulic piston 52 to its upward position. The two override subsystems that are depicted in FIGS. 3 and 4 may be combined to form a bidirectional hydraulic override subsystem that is depicted in FIG. 5. Thus, with the bidirectional override subsystem of FIG. 5, the piston 52 may be moved either upwardly or downwardly, depending on whether the hydraulic line 64 or the hydraulic line 62 is pressurized, with the other hydraulic line 62, 64 being used as the return line.

It is noted that the exemplary override subsystems described in connection with FIGS. 2, 3, 4 and 5 are not redundant systems and do not use any additional hydraulic lines.

Figure 6:
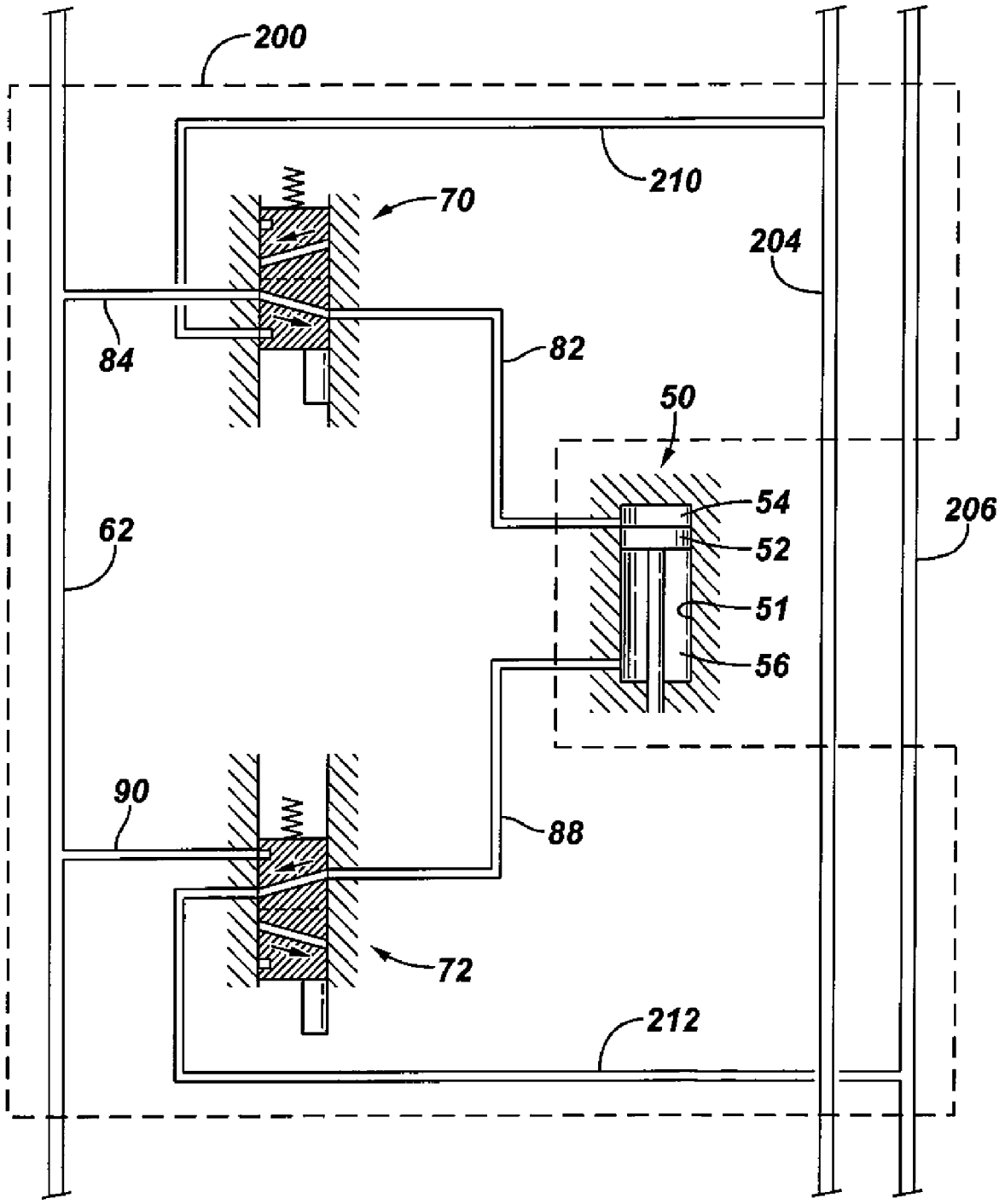
FIG. 6 is a schematic diagram of a primary control subsystem according to another embodiment of the invention.

FIG. 6 depicts a primary control subsystem 200 in accordance with other embodiments of the invention. In general, the primary control subsystem 200 replaces the primary control subsystem 44, with like reference numerals being used to denote similar components. However, unlike the primary control subsystem 44, the primary control subsystem 200 includes two hydraulic lines 204 and 206 that serve as return lines and collectively replace the hydraulic line 64.

In normal operation of the primary control subsystem 200, the hydraulic line 204 serves as the return line for the upper hydraulic chamber 54, and as such, a line 210 connects the solenoid valve 70 to the hydraulic line 204. Furthermore, during normal operation of the primary control subsystem 200, the hydraulic line 206 serves as the return line for the lower hydraulic chamber 56, and as such, a line 212 connects the solenoid valve 72 to the hydraulic line 206. During normal operation of the primary control subsystem 200, the hydraulic line 62 is pressurized, and the solenoid valves 70 and 72 are operated for purposes of moving the piston 52 either upwardly or downwardly, depending on the desired state for the downhole tool 40. Thus, to move the piston 52 downwardly, a solenoid valve 70 is activated, and the hydraulic line 206 serves as the return line. Conversely, to move the piston 52 upwardly, the solenoid valve 72 is activated, and the hydraulic line 204 serves as the return line.

Figure 7:
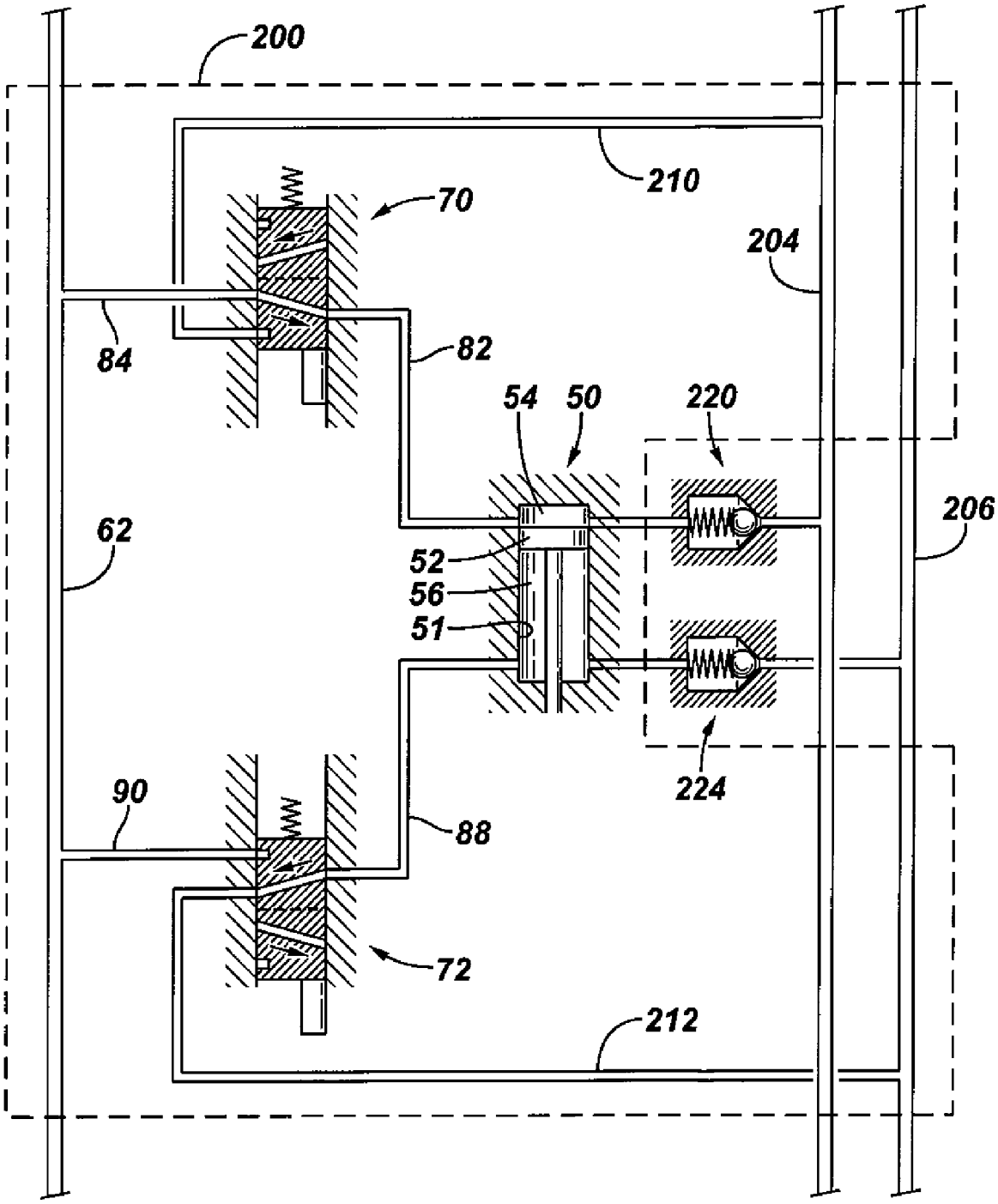
FIG. 7 is a schematic diagram of the primary control subsystem of FIG. 6 and an override subsystem according to an embodiment of the invention.

Referring to FIG. 7, in accordance with embodiments of the invention, an override subsystem that includes two check valves 220 and 224 may be used with the primary control subsystem 200 for purposes of implementing a bidirectional override subsystem. The inlet of the check valve 220 may be connected to the hydraulic line 204, and the outlet of the check valve 220 may be connected to the upper hydraulic chamber 54. The inlet of the check valve 224 may be connected to the hydraulic line 206, and the outlet of the check valve 224 may be connected to the lower hydraulic chamber 56. During normal operation of the primary control subsystem 200, the check valves 220 and 224 remain closed.

When a need arises to override the primary control subsystem 200, the hydraulic lines 204 and 206 may be selectively pressurized, depending on the desired movement for the piston 52. More specifically, to drive the piston 52 downwardly, the hydraulic line 204 is pressurized, and the hydraulic line 206 serves as the return line. Conversely, to derive the piston 52 upwardly, the hydraulic 206 is pressurized, and the hydraulic line 204 serves as the return line.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

a piston to actuate a downhole tool;

a primary control subsystem connected to a first hydraulic line and a second hydraulic line to move the piston in a given direction in response to fluid communicated to the downhole tool via the first hydraulic line and fluid communicated away from the downhole tool via the second hydraulic line; and an override subsystem connected to the first hydraulic line and the second hydraulic line to override the primary control subsystem and move the piston in the given direction in response to fluid communicated to the downhole tool via the second hydraulic line and fluid communicated away from the downhole tool via the first hydraulic line.

2. The system of claim 1, further comprising:

a cylinder to house the piston to form first and second control chambers to control movement of the piston, wherein the override subsystem comprises a check valve to establish communication between the second hydraulic line and the first chamber in response to the pressure in the second hydraulic line.

3. The system of claim 2, wherein the override subsystem comprises another check valve to establish communication between the first hydraulic line and the second chamber in response to the pressure in the second hydraulic line.

4. A method useable in a well, comprising:

providing a downhole tool comprising a piston to actuate the tool;

providing a primary control subsystem connected to a first hydraulic line and a second hydraulic line;

moving the piston with the primary control subsystem in a given direction in response to fluid communicated to the downhole tool via the first hydraulic line and fluid communicated away from the downhole tool via the second hydraulic control line;

providing an override subsystem connected to the first hydraulic line and second hydraulic line;

overriding the primary control subsystem and moving the piston in the given direction in response to fluid communicated to the downhole tool via the second hydraulic line and fluid communicated away from the downhole tool via the first hydraulic line.

5. The method of claim 4, wherein the overriding comprises opening communication through at least one check valve.

6. The method of claim 4, wherein the primary control subsystem is actuated by moving a piston of the downhole tool and the overriding comprises moving the piston of the downhole tool.

* * * * *